United States Patent [19]

Hodel

[11] 4,365,628

[45] Dec. 28, 1982

[54] AVALANCHE SURVIVAL VEST

[76] Inventor: Carl F. Hodel, 1720A Paula Dr., Honolulu, Hi. 96816

[21] Appl. No.: 173,127

[22] Filed: Jul. 28, 1980

[51] Int. Cl.[3] ..... A62B 7/02

[52] U.S. Cl. ..... 128/205.12; 128/205.24; 128/205.21; 128/207.16

[58] Field of Search ..... 128/201.23, 201.25, 128/201.26, 201.28, 202.26, 205.11, 205.12, 205.17, 205.21, 205.22, 205.24, 205.25, 205.28, 206.15, 206.29, 207.12, 207.16, 201.11, 204.26

[56] References Cited

U.S. PATENT DOCUMENTS

| | | | |
|---|---|---|---|
| 59,386 | 11/1866 | Goodwillie | 128/207.12 |
| 374,831 | 12/1887 | Harrington | 128/207.12 |
| 439,093 | 10/1890 | Barian | 128/206.29 |
| 1,814,506 | 7/1931 | Davis | 128/205.17 |
| 2,444,029 | 6/1948 | Bowen | 128/202.26 |
| 2,488,261 | 11/1949 | Bedini | 128/201.11 |
| 2,852,023 | 9/1958 | Hamilton et al. | 128/205.12 |
| 3,762,407 | 10/1973 | Showerd | 128/201.23 |
| 4,163,448 | 8/1979 | Grouard | 128/204.26 |
| 4,164,218 | 8/1979 | Martin | 128/202.26 |

FOREIGN PATENT DOCUMENTS

| | | | |
|---|---|---|---|
| 493160 | 3/1930 | Fed. Rep. of Germany | 128/205.12 |
| 579376 | 6/1933 | Fed. Rep. of Germany | 128/205.12 |
| 340371 | 5/1936 | Italy | 128/206.15 |
| 297854 | 12/1922 | United Kingdom | 128/206.29 |

*Primary Examiner*—Henry J. Recla

[57] ABSTRACT

This invention, the snow avalanche survival vest consists of a vest to be worn around the chest by skiers, and mountaineers. It is designed to provide oxygen to breath and to serve as a flotation device to help victims survive if caught in an avalanche. The vest has a $CO_2$ absorber chamber, a mouthpiece breathing hose, and a compressed oxygen cartridge which can be released instantly by biting hard on the mouthpiece hose or pushing a button on the mouthpiece hose. The vest has external air ports in the mouthpiece hose which allow breathing of external air until the $O_2$ cartridge is activated. Bite or pushbutton activation of the vest also seals the external air ports instantly. Thus, the victim of an avalanche can breath oxygen while trapped under the snow and greatly increase his available rescue time.

6 Claims, 15 Drawing Figures

AVALANCHE SURVIVAL VEST

SUMMARY OF THE INVENTION

General Introduction

Each year many people die in snow avalanches while back-packing, cross country skiing, downhill skiing, helicopter skiing, and during mountaineering activities. Many of these people are trapped under the avalanche unable to move or breath and die essentially from suffocation in about four minutes. This is a very short time for rescue crews to dig out the victim. If an air supply were available to the victim while trapped in the snow, he could remain alive much longer providing he does not die from other injuries. This would greatly increase his chances for survival.

Purpose

The purposes of this invention are: (1) to provide additional oxygen for the avalanche victim to breath, (2) to establish and maintain an airway, (3) to insulate the chest and lungs from snow pressure compression, (4) to insulate the victim from heat loss, (5) to cushion the chest from injury during the avalanche slide, (6) to serve as a flotation device to help float the victim to the surface while in the avalanche.

DESCRIPTION OF INVENTION

This invention consists essentially of a vest to be worn around the chest and back. The vest is made of strong durable material and has an air chamber which is expandable and may be filled with air or oxygen. The vest has a hose attached to the air chamber with a mouthpiece and a compressed oxygen ($O_2$) or air cylinder which when released will fill the vest with oxygen or air. The oxygen may then be breathed through the mouthpiece held in the users' mouth.

In actual use, one would not activate the vest until an avalanche occurred. Several methods of activating the vest are conceived. With Model (1), the victim would insert the mouthpiece into his mouth and pull the $O_2$ cylinder release cord to inflate the vest and simply breath the $O_2$ (inhale and exhale into the vest) out of and into the vest.

Since avalanches occur suddenly and unexpectedly and often knock the skier, climber, or victim down without time to manipulate a vest by hand cord, a second model is also devised. This Model (2) has a mouthpiece which is worn in the mouth while skiing, climbing, or working in dangerous avalanche areas. The mouthpiece hose has an external air ports through which atmospheric air passes to the users' mouth to accomodate normal breathing before the avalanche occurs. When an avalanche occurs, the user activates the vest very rapidly and easily by biting hard on the mouthpiece. This compresses the mouthpiece and through a mechanical cable mechanism or other mechanism does two things. One, it punctures the air or $O_2$ cartridge to release the $O_2$ and fills the vest with $O_2$. Second, it releases a slide cover to shut off the external air ports. Thus, by biting once as the victim responds to the awareness of being caught in an avalanche, he converts his airway from external air to self-contained recirculating oxygen.

A third model is basically the same as the second except it has a push button release on the mouthpiece hose which activates the $O_2$ cartridge by cable or other means and closes the external air port.

Once inflated, the user, if trapped under the snow, continues to breath $O_2$ from the vest mouthpiece. He does not have to move or be able to move his chest, since as he takes in $O_2$ from the vest, his combined outer body and vest volume remains constant because there is only transfer of $O_2$ from vest to lung and back. This will enable the user to breath until he is hopefully rescued or dug out.

All of these vests also contains $CO_2$ absorber chambers to remove $CO_2$ from the vest and help prevent hypercapnia. Optional other features are: (1) a high pressure air release valve on the vest to prevent rupture; (2) a surge valve on the mouthpiece hose to prevent rapid loss of $O_2$ from vest due to sudden extreme compression during the avalanche.

DRAWING FIGURE INDEX

FIG. 1: Front View of Device
FIG. 2: Side View of Device
FIG. 3: Sectional View of Pressure Relief Valve
FIG. 4: Sectional View of Oxygen Bottle Valve, Closed
FIG. 5: Sectional View of Oxygen Bottle Valve, Open
FIG. 6: End View of Oxygen Bottle
FIG. 7: Front View of Mouthpiece and Valve Assy.
FIG. 8: Side View of Mouthpiece and Valve Assy.
FIG. 9: Perspective View of Mouthpiece and Valve Assembly
FIG. 10: Sectional View of Alternate Pushbutton Mouthpiece and Valve Assembly, Valve Opened
FIG. 11: Sectional View of Alternate Pushbutton Mouthpiece and Valve Assembly, Valve Closed
FIG. 12: End View of Mouthpiece with Pushbutton Valve Assembly
FIG. 13: Side View of Tension Adjuster
FIG. 14: Side View of Alternate Bite Activation Mouthpiece Assembly
FIG. 15: Sectional View Surge Valve Assembly

INDEX OF PARTS REFERENCED BY NUMBERS

1. Device, Vest
2. Mouthpiece
3. Upper Hose
4. Valve Assembly, Outside/Inside Breathing
5. Lower Hose
6. $CO_2$ Absorber Chamber
7. Oxygen Bottle and Valve Plug Assembly
8. Pressure Relief Valve
9. Shoulder Straps
10. Waist
11. Reserved
12. Reserved
13. Reserved
14. Reserved
15. Mouthpiece Bite Area, Upper
16. Mouthpiece Bite Area, Lower
17. Opening
18. Mouthpiece Trigger Assy.
19. Upper Pad
20. Brace
21. Shaft, Upper
22. Lever, Restraining
23. Attaching Point, Cable Housing
24. Lower Pad 25. Brace
26. Shaft, Lower
27. Lever, Actuating
28. Attaching Point, Cable
29. Cable Housing, Breathing Valve
30. Cable, Breathing Valve
31. Cable Housing, $O_2$ Bottle
32. Cable, $O_2$ Actuator
33. Pin
34. Housing
35. Loop
36. Adjusting Nut Sleeve
37. Lock Nut
38. Axial Slot
39. Bearing
40. Slide Housing
41. Opening, Atmosphere
42. Valve Stop
43. Spring
44. Slide
45. Slide Seal
46. Reserved
47. Reserved
48. Reserved
49. Reserved
50. Opening, Atmosphere
51. Plug
52. Shaft
53. Push Button
54. Housing, Shaft
55. Attaching Point
56. Pulley
57. Brace, Cable
58. Reserved
59. Reserved
60. Spool Valve
61. Opening
62. Spring
63. Cover, Outside
64. Opening(s)
65. Rivets
66. Housing
67. Opening(s)
68. Reserved
69. Reserved
70. $O_2$ Bottle
71. Thread, Male
72. Thread, Female
73. Housing
74. Adjusting Plug
75. Opening Allen Wrench
76. Thread, Male
77. Thread, Female
78. Spring
79. Plunger
80. Opener
81. Plug
82. Opening(s) (8)
83. Pin
84. Housing
85. Reserved
86. Reserved
87. Reserved
88. Reserved
89. Reserved
90. Spool Valve
91. Spring
92. Seat
93. By-Pass
94. Spring Seat
95. Housing

DETAILED DESCRIPTION OF AVALANCHE SURVIVAL VEST WITH BITE ACTIVATION MECHANISM

Figure 1:
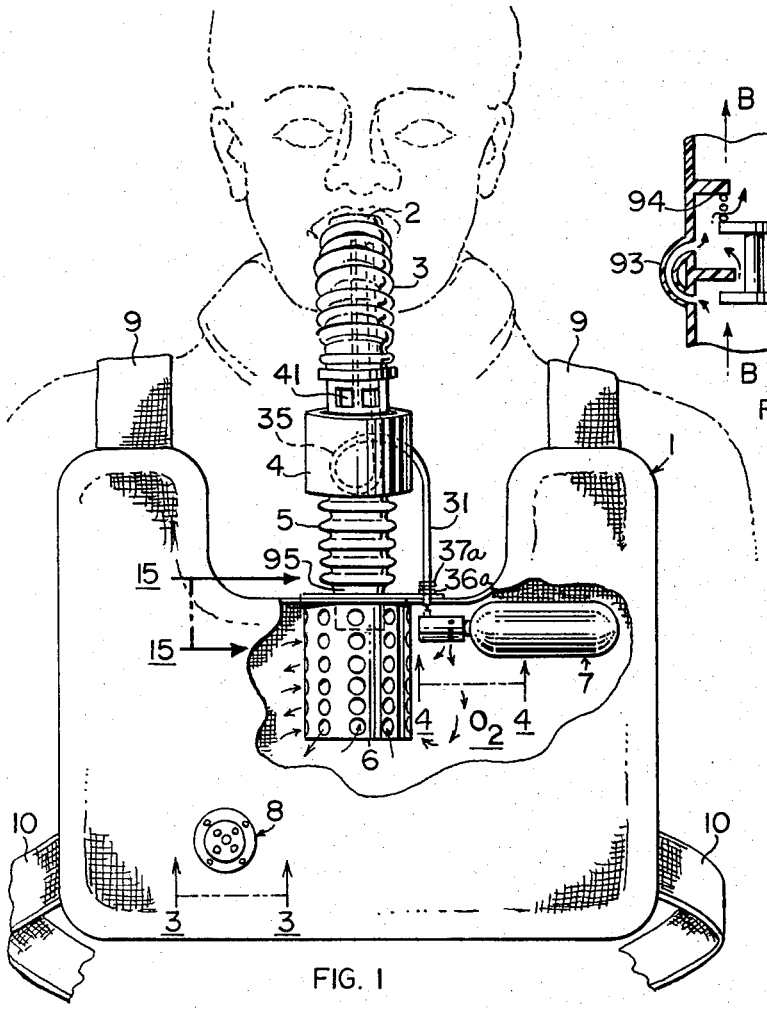
Figure 2:
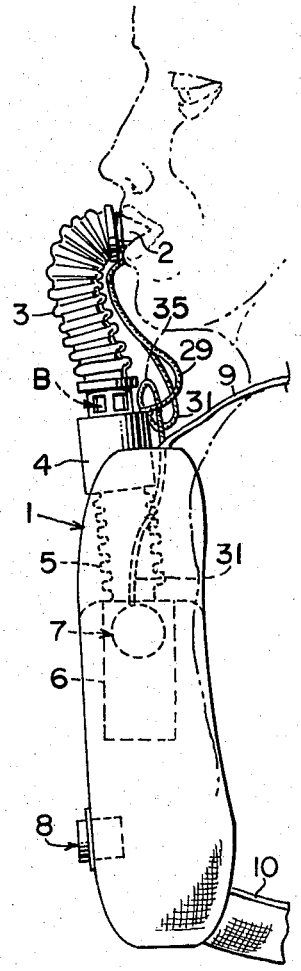
Figure 7:
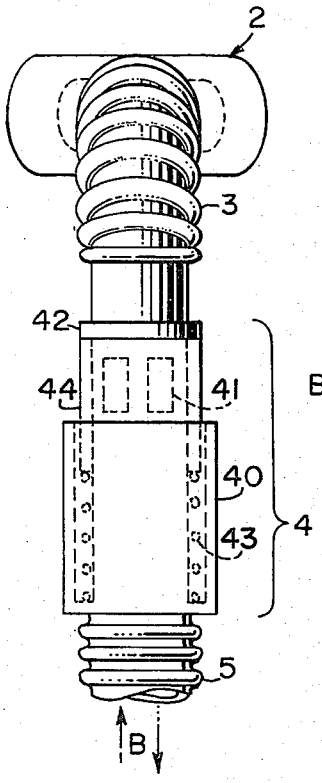
Figure 8:
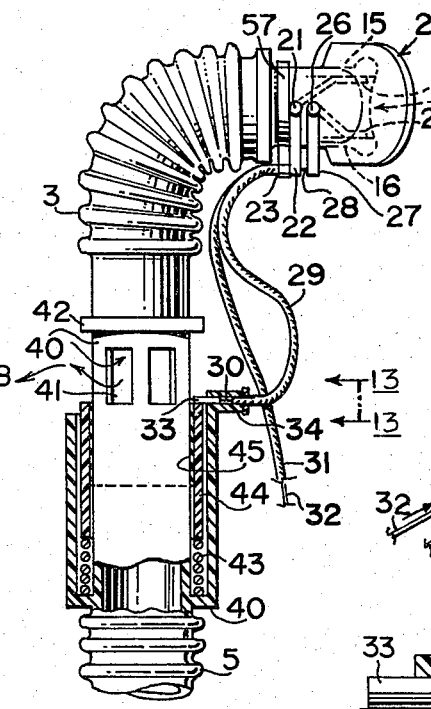
Figure 9:
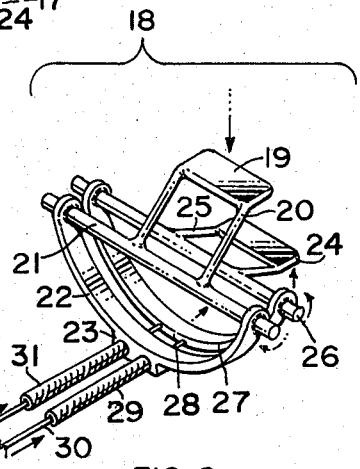
Figure 13:
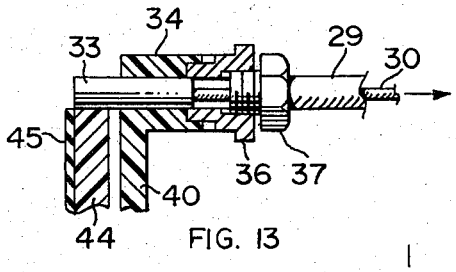

FIGS. 1 and 2 show front and side views of vest with inflatable chamber (1) and breathing hose (3) and (5) attached. The vest could be designed with an air chamber that either surrounds the chest and back totally or only partially as shown with the anterior chest air chamber diagrammed in FIG. 1. Straps (9) and (10) are adjustable to hold the vest in proper position. User places mouthpiece (2) with bite area (15) and (16) in mouth and breathes atmospheric air through external air ports (41) while skiing or operating in a potential avalanche area. Should an avalanche occur user activates the system rapidly by biting completely on the rubber, elastic mouthpiece (2) and releasing (FIG. 7 and 8). As shown in FIG. 9, or alternate design FIG. 14, this compresses the mouthpiece trigger assembly (18) and moves the metal or plastic pads (19 and 24) (19*a* and 24*a*) and arms (20 and 25), (20*a* and 25*a*) inside the mouthpiece which turns shafts (21 and 26), (21*a* and 26*a*) and separates levers (22 and 27), (22*a* and 27*a*) to which are attached cables (30 and 32) at attaching point (28 and 28*a*) and cable housings (29 and 31) at attaching point (23 and 23*a*).

Figure 14:
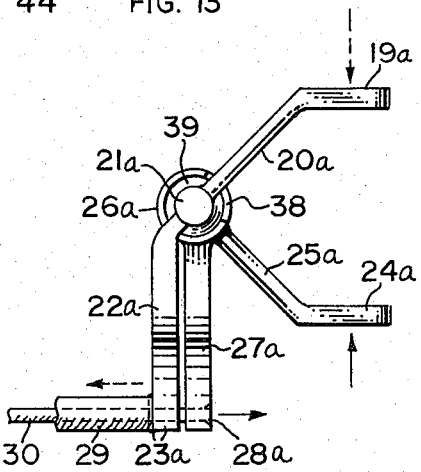

FIGS. 9 and 14 show two different designs for the mouthbite mechanism. FIG. 9 is a biaxial lever mechanism with two shafts (21 and 26). FIG. 14 is a coaxial lever mechanism with one shaft (21*a*) inside outer shaft (26*a*) which has slots (38) for levers (20*a*). The shafts turn on bearings (39).

Figure 4:
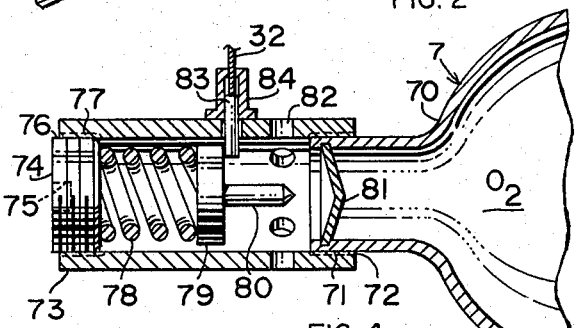
Figure 6:
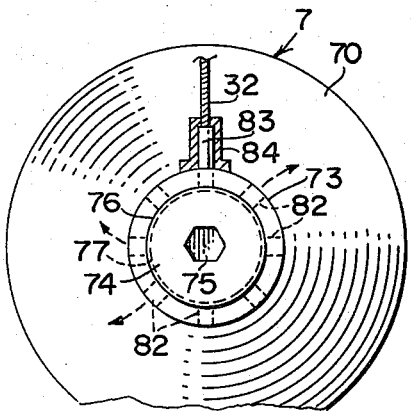
Figure 5:
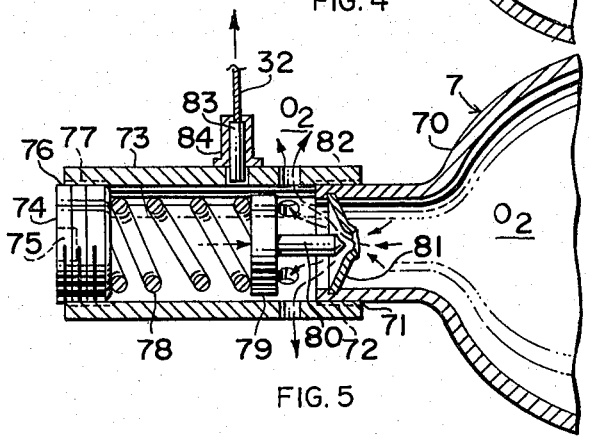

Biting on the mouthpiece thereby pulls holding pins (83 and 33), (FIGS. 4, 5, 8, and 13) in housing (84 and 34) which activates the oxygen bottle and valve assembly (7 and 70), (FIG. 4 and 5), and closes the external slide (44) over air ports (41) on slide housing (40) against valve stop (42). Holding pin (83), (FIGS. 4 and 5) inside housing (84) locks a spring (78) loaded plunger (79) inside housing (73) which, when released by pulling holding pin (83), slides forward driving the opener (80) into the plug (81) of the oxygen bottle (70). The oxygen is then released through the openings (82) into the vest chamber (1) and fills the vest with oxygen which is breathed by passing through the carbon dioxide ($CO_2$) scrubber (6) into the flexible hose FIG. 7 (5, 4, 3, and 2) and on into the users mouth. FIGS. 5 and 6 show adjusting plug (74) with threads (76 and 77) and allen wrench plug (75) to set plunger spring pressure (78).

User exhales air back into the mouthpiece hose (FIG. 7), (2, 3, 4, and 5) and the air passes through the $CO_2$ absorber (6) back into the vest chamber (1). Expired air has oxygen ($O_2$) and carbon dioxide ($CO_2$) in it. This avoids wasting the $O_2$ by rebreathing it until it is all consumed by the body.

Pin (33), (FIGS. 8 and 13), locks open the external air port (41) through which the user breathes normal atmospheric air before the vest $O_2$ is needed. Pulling pin (33) in housing (34) by biting on the mouthpiece (through cable assembly [29 and 30]) releases the external port slide cover (44) which is pushed against stop (42) over the external air ports (41) by spring (43) inside slide housing (40) thereby closing air ports (41) to the external atmosphere. This prevents the loss of $O_2$ from the vest and user during an emergency. Slide seal (45) prevents air leakage of $O_2$ from the vest.

Cable tension adjusters (FIG. 13) on threaded cable housings (29 and 31) with adjusting sleeve nut (36) and locking nut (37) are provided to properly set tension on cables (29, 30, 31, and 32) so that pins (83 and 33) are released by proper mouthbite. Once used, the $O_2$ bottle and valve (7 and 70) is unscrewed from housing (73) by threads (71 and 72), and pins (83 and 33) are reset after external port slide cover (44) and plunger (79) are recompressed into slide housings (40 and 73) by hand or by using a reset tool which could be a cylinder of smaller diameter than the plunger housing (73) internal diameter. The reset tool would have a slot on the side to allow the tool to slide past the pin (83). A new $O_2$ is then screwed into housing (73). Mouthpiece hose is attached to velcro or other strap holder on side shoulder of vest during non-use. FIG. 1 shows a loop (35) in cable housings to allow freedom of movement of the mouthpiece hose during use.

DETAILED DESCRIPTION OF AVALANCHE SURVIVAL VEST WITH PUSHBUTTON ACTIVATION MECHANISM

Figure 10:
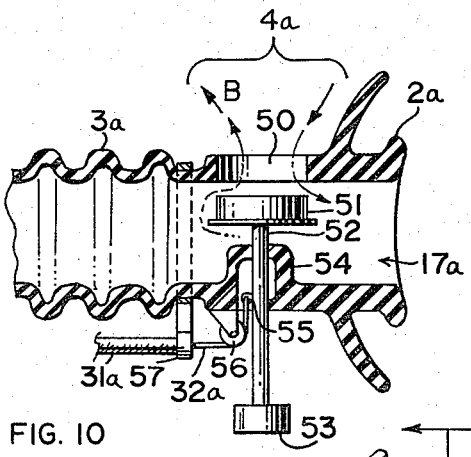
Figure 11:
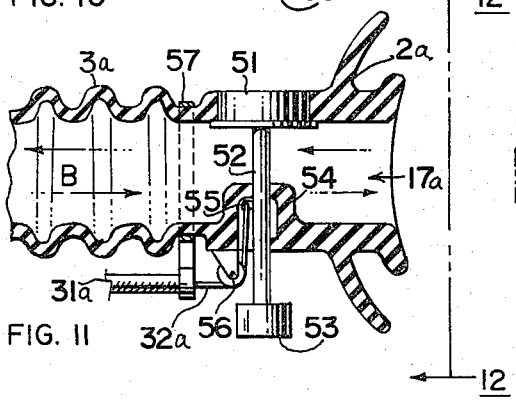
Figure 12:
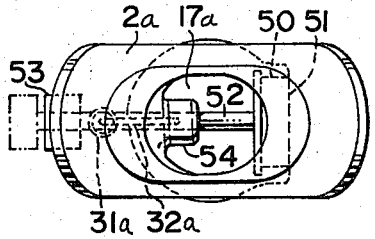

FIGS. 1 and 2 show front and side views of vest (1) with breathing hose (3) attached. User places mouthpiece (2*a*), (FIGS. 10, 11, and 12) in mouth and breathes atmospheric air through opening (17*a*) and external air port (50) while skiing or climbing in a potential avalanche area. Should an avalanche occur, user activates system rapidly by pushing button (53) which drives shaft (52) in housing (54) and plug (51) into external air port (50) thereby sealing off external air flow.

Pushing button (53) also activates the $O_2$ bottle by pulling cable (32*a*) attached to shaft (53) at point (55) over pulley (56). Cable housing (31*a*) is held by cable brace (57). Cable (32*a*) is attached to holding pin (83), (FIGS. 4 and 5), which releases plunger (79 and 80) which is driven forward by spring (78) and ruptures plug (81) of the $O_2$ bottle valve assembly (7). This releases oxygen into the vest through openings (82) in housing (73).

The user then breathes the oxygen in the vest which passes through the $CO_2$ absorber (6) into flexible hose (FIG. 7, [5, 4, 3, and 2]) and into the users' mouth. User exhales back into the mouthpiece hose (FIG. 7[2, 3, 4, and 5]) and the air passes through the $CO_2$ absorber (6) back into the vest chamber (1). This avoids wasting $O_2$ in the expired air.

Tension adjusters on threaded cable housings (29 and 31, FIG. 13) with adjusting sleeve nut (36) and locking nut (37) set tension on cable (32*a*) so that pin (83) is released by proper movement of pushbutton (53).

Once used, the $O_2$ bottle (70) is unscrewed from housing (73) and the pushbutton (53, FIG. 10) is moved back to the open port position. Plunger (79) is recompressed into housing (73) with a reset tool as described previously and pin (83) is reset in the lock position (FIG. 4). A new $O_2$ bottle is then screwed into housing (73). Mouthpiece hose is attached to velcro or other scrap holder on sideshoulder of vest during non-use. FIG. 1 shows a loop (35) in cable housing to allow freedom of movement of the mouthpiece during use.

Figure 3:
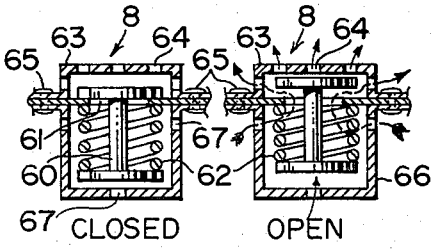

DESCRIPTION OF THE OPTIONAL HIGH PRESSURE RELIEF VALVE, FIGS. 1 and 3

This is a valve designed to protect the vest from bursting due to sudden high pressure of compression during the avalanche. Pressure relief valve (8), (FIG. 1), is attached to vest (1) wall with rivets (65) holding housing (66) which contains spool valve (60) and spring (62). Vest $O_2$ transmits vest air pressure through openings (67) and, if too much pressure is created, opens valve (60) by compressing spring (62). This lets $O_2$ escape through opening (61) in the spool valve seat and openings (64) in the cover (63) to the outside of the vest thereby reducing air pressure inside the vest to help keep it from rupturing.

DESCRIPTION OF OPTIONAL SURGE FLOW VALVE IN THE REBREATHING HOSE, FIG. 15.

Figure 15:
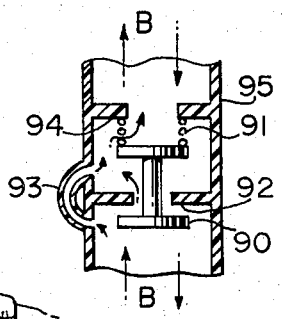

This valve, (FIG. 15), sits in the hose (5), (FIG. 1) and prevents loss of $O_2$ due to rapid compression of the vest during an avalanche from the hose if the users' mouth airway resistance should fail. FIG. 15 shows detail of spool valve (90) with spring (91) on spring seat (94) in housing (95). If the air pressure suddenly increases, spool valve (90) will close on seat (92) shutting off the air flow through the spool valve. The spool valve will remain closed until the air pressure differential between the vest and the hose is reduced by air moving through bypass (93). Once the extreme air pressure difference is reduced, the valve will reopen to allow normal breathing through the mouthpiece hose from the vest.

I claim:

1. A breathing apparatus comprising in combination:
   - an air reservoir bag to be worn around the users chest or back,
   - an inhalation duct having one end connected to said reservoir bag, a mouthpiece connected to the other end of said inhalation duct,
   - a $CO_2$ absorber chamber mounted within the reservoir bag between the inhalation duct and the reservoir air supply to absorb $CO_2$ from the recycled air,
   - a special set of external breathing ports in said inhalation duct near said mouthpiece to allow breathing of external atmospheric air,
   - valve means slidably mounted over said ports from a first position in which said ports are open to atmosphere to a second position closing said ports,
   - a cylinder of compressed breathing gas attached to the reservoir bag, said cylinder having a puncturable cap, a spring loaded puncture pin mounted adjacent said cap to puncture said cap when activated,
   - a bite activation means consisting of lever arms built into the mouthpiece and a mechanical cable mechanism connected between said lever arms and said valve means to instantly release the external breathing port valve cover and close the external ports and between said lever arms and said spring loaded puncture pin to simultaneously release said spring loaded puncture pin which will open the compressed breathing gas cylinder allowing the breathing gas to fill the reservoir bag.

2. A breathing apparatus comprising in combination:
   - an air reservoir bag to be worn around the users chest or back,
   - an inhalation duct having one end connected to said reservoir bag, a mouthpiece connected to the other end of said inhalation duct,
   - a $CO_2$ absorber chamber mounted within the reservoir bag between the inhalation duct and the reservoir air supply to absorb $CO_2$ from the recycled air, an external breathing port in said inhalation duct near said mouthpiece to allow breathing of external atmospheric air, a cylinder of compressed breathing gas attached to the reservoir bag, said cylinder having a puncturable cap, a spring loaded puncture pin mounted adjacent said cap to puncture said cap when activated, pushbutton release means consisting of a valve shaft slidably mounted through said inhalation duct in alignment with said external breathing port, a valve plug mounted on one end of said shaft to close said port and a thumb pressure plate mounted on the other end of said shaft and a mechanical cable mechanism connected between said valve shaft and said spring loaded puncture pin to simultaneously release said spring loaded puncture pin when said external breathing port is closed which will open the compressed breathing gas cylinder allowing the breathing gas to fill the reservoir bag.

3. A breathing apparatus comprising in combination:

an air reservoir bag to be worn around the users chest or back, an inhalation duct having one end connected to said reservoir bag, a mouthpiece connected to the other end of said inhalation duct, a $CO_2$ absorber chamber mounted within the reservoir bag between the inhalation duct and the reservoir air supply to absorb $CO_2$ from the recycled air, a special set of external breathing ports in said inhalation duct near said mouthpiece to allow breathing of external atmospheric air, valve means slidably mounted over said ports from a first position in which said ports are open to atmosphere to a second position closing said ports, a cylinder of compressed breathing gas attached to the reservoir bag, said cylinder having a puncturable cap, a spring loaded puncture pin mounted adjacent said cap to puncture said cap when activated, bite activation means consisting of lever arms built into the mouthpiece and a mechanical cable mechanism connected between said lever arms and said valve means to instantly release the external breathing port valve cover and close the external ports and between said lever arms and said spring loaded puncture pin to simultaneously release said spring loaded puncture pin which will open the compressed breathing gas cylinder allowing the breathing gas to fill the reservoir bag, surge flow valve means mounted in said inhalation duct to temporarily close during short sudden periods of high compression on the reservoir bag and prevent rapid loss of breathing gas from the reservoir bag and a by-pass duct around said surge flow valve means to provide limited flow in said inhalation duct during said periods.

4. A breathing apparatus comprising in combination:

an air reservoir bag to be worn around the users chest and back, an inhalation duct having one end connected to said reservoir bag, a mouthpiece connected to the other end of said inhalation duct, a $CO_2$ absorber chamber mounted within the reservoir bag between the inhalation duct and the reservoir air supply to absorb $CO_2$ from the recycled air, an external breathing port in said inhalation duct near said mouthpiece to allow breathing of external atmospheric air, a cylinder of compressed gas attached to the reservoir bag, said cylinder having a puncturable cap, a spring loaded puncture pin mounted adjacent said cap to puncture said cap when activated, pushbutton release means consisting of a valve shaft slidably mounted through said inhalation duct in alignment with said external breathing port, a valve plug mounted on one end of said shaft to close said port and a thumb pressure plate mounted on the other end of said shaft and a mechanical cable mechanism connected between said valve shaft and said spring loaded puncture pin to simultaneously release said spring loaded puncture pin when said external breathing port is closed which will open the compressed breathing gas cylinder allowing the breathing gas to fill the reservoir bag, and surge flow valve means mounted in said inhalation duct to temporarily close during short sudden periods of high compression on the reservoir bag and prevent rapid loss of breathing gas from the reservoir bag and a by-pass duct around surge flow valve means to provide limited flow in said inhalation duct during said periods.

5. A breathing apparatus comprising in combination:

an air reservoir bag to be worn around the users chest or back, an inhalation duct having one end connected to said reservoir bag, a mouthpiece connected to the other end of said inhalation duct, a $CO_2$ absorber chamber mounted within the reservoir bag between the inhalation duct and the reservoir air supply to absorb $CO_2$ from the recycled air, a special set of external breathing ports in said inhalation duct near said mouthpiece to allow breathing of external atmospheric air, valve means slidably mounted over said ports from a first position in which said ports are open to atmosphere to a second position closing said ports, a cylinder of compressed breathing gas attached to the reservoir bag, said cylinder having a puncturable cap, a spring loaded puncture pin mounted adjacent said cap to puncture said cap when activated, bite activation means consisting of lever arms built into the mouthpiece and a mechanical cable mechanism connected between said lever arms and said valve means to instantly release the external breathing port valve cover and close the external ports between said lever arms and said spring loaded puncture pin to simultaneously release said spring loaded puncture pin which will open the compressed breathing gas cylinder allowing the breathing gas to fill the reservoir bag, surge flow valve means mounted in said inhalation duct to temporarily close during short sudden periods of high compression on the reservoir bag and prevent rapid loss of breathing gas from the reservoir bag, a by-pass duct around said surge flow valve means to provide limited flow in said inhalation duct during said periods, and a high pressure vest air relief valve means attached to the reservoir bag wall, said relief valve means allowing breathing gas to excape from the reservoir bag to the atmosphere during periods of sudden extreme compressing of the reservoir bag and thereby preventing rupture of the reservoir bag.

6. A breathing apparatus comprising in combination:

an air reservoir bag to be worn around the users chest or back, an inhalation duct having one end connected to said reservoir bag, a mouthpiece connected to the other end of said inhalation duct, a $CO_2$ absorber chamber mounted within the reservoir bag between the inhalation duct and the reservoir air supply to absorb $CO_2$ from the recycled air, an external breathing port in said inhalation duct near said mouthpiece to allow breathing of external atmospheric air, a cylinder of compressed breathing gas attached to the reservoir bag, said cylinder having a puncturable cap, a spring loaded puncture pin mounted adjacent said cap to puncture said cap when activated, pushbutton release means consisting of a valve shaft slidably mounted through said inhalation duct in alignment with said external breathing port, a valve plug mounted on one end of said shaft to close said port and a thumb pressure plate mounted on the other end of said shaft and a mechanical cable mechanism connected between said valve shaft and said spring loaded puncture pin to simultaneously release said spring loaded puncture pin when said external breathing port is closed which will open the compressed breathing gas cylinder allowing the breathing gas to fill the reservoir bag, surge flow valve means mounted in said inhalation duct to temporarily close during short sudden periods of high compression on the reservoir bag and prevent rapid loss of breathing gas from the reservoir bag, a by-pass duct around said surge flow valve means to provide limited flow in said inhalation duct during said periods, and a high pressure vest air relief valve means attached to the reservoir bag wall, said relief valve means allowing breathing gas to escape from the reservoir bag to the atmosphere during periods of sudden extreme compression of the reservoir bag and thereby preventing rupture of the reservoir bag.

* * * * *